United States Patent [19]

Alger

[11] Patent Number: 4,632,477

[45] Date of Patent: Dec. 30, 1986

[54] GROUNDING DEVICE

[76] Inventor: Monroe E. Alger, 10309 Godwin Dr., Manassas, Va. 22110

[21] Appl. No.: 710,122

[22] Filed: Mar. 11, 1985

[51] Int. Cl.[4] ..... H01R 4/66

[52] U.S. Cl. ..... 339/14 R; 339/14 L; 339/272 R

[58] Field of Search ..... 339/14, 272 R, 13, 266 G, 339/192 R; 174/51; 220/3.2, 3.3

[56] References Cited

U.S. PATENT DOCUMENTS

| | | | |
|---|---|---|---|
| 1,791,264 | 2/1931 | Chaney et al. | 174/51 X |
| 2,337,212 | 12/1943 | Thomson et al. | 339/192 R X |
| 2,533,897 | 12/1950 | Reddock | 339/13 X |
| 3,325,776 | 6/1967 | Eppler | 339/272 R |
| 3,390,368 | 6/1968 | Archer | 339/14 R |
| 4,159,859 | 7/1979 | Shemtov | 339/14 L |
| 4,189,198 | 2/1980 | Reichman | 339/14 L X |
| 4,427,258 | 1/1984 | Mueller | 339/272 R |

*Primary Examiner*—Eugene F. Desmond
*Attorney, Agent, or Firm*—Dennis H. Lambert

[57] ABSTRACT

A grounding device for electrical connectors includes, in a first variation, lay-in grounding lugs for use on existing wall receptacles and on clamps, and, in a second variation, automatic grounding connections between the ground socket and back plate of an electrical receptacle. The lay-in grounding lugs comprise a channeled body and a clamping plate for releasable attachment to the body to clamp a ground wire therebetween. The body and clamping plate have interfitting flanges which react against a clamping screw threaded through the clamping plate into engagement with a wire laid in the channel of the body. In use, a ground wire can be easily laid into the channel and the clamping plate and screw then fitted, substantially increasing the ease and speed of making ground connections. The automatic ground connections comprise a first form in which the screw that secures the ground socket to the receptacle also extends through the back plate of the receptacle, establishing a ground connection between the ground socket and the back plate. In a second form, an extension is provided from the ground wire clamping plate of the ground socket to the back plate of the receptacle, establishing a ground connection therebetween.

5 Claims, 14 Drawing Figures

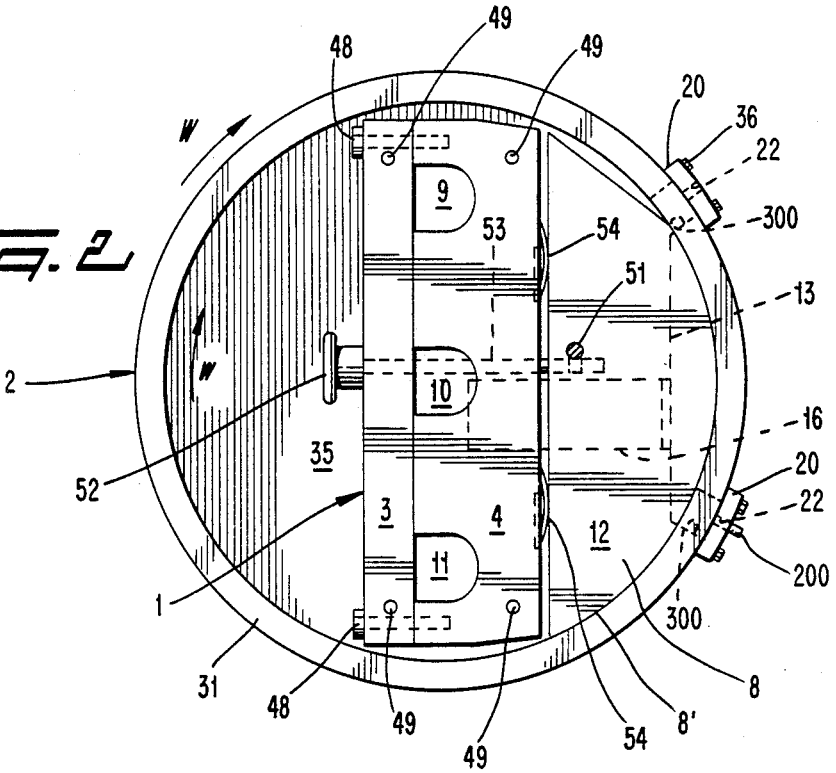
Fig. 2
Fig. 3
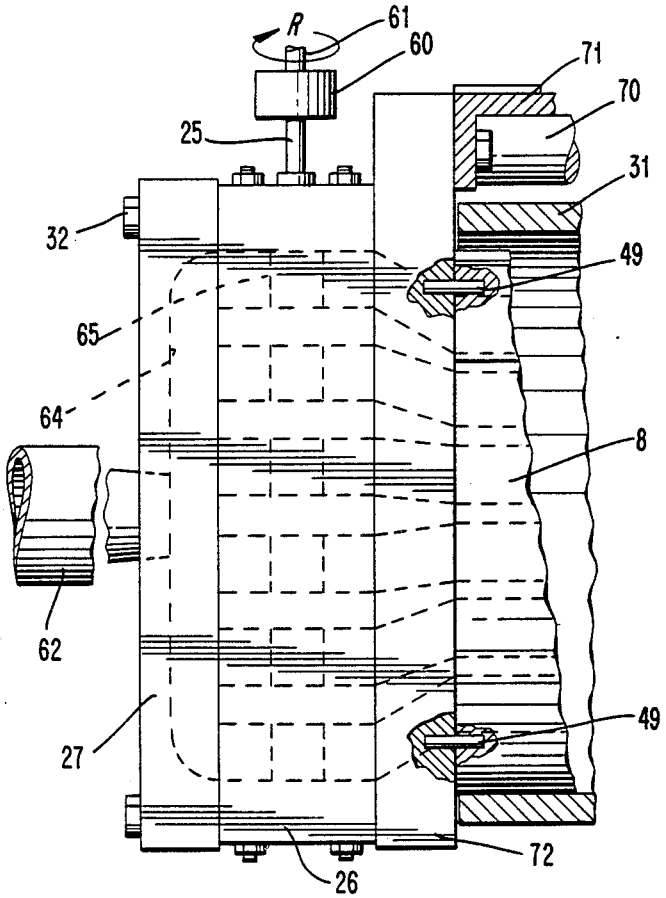
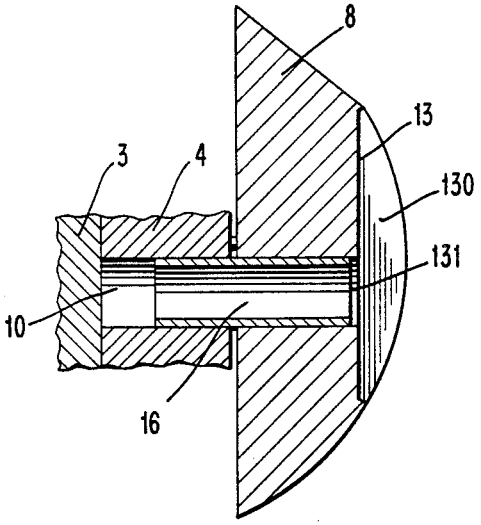
Fig. 5

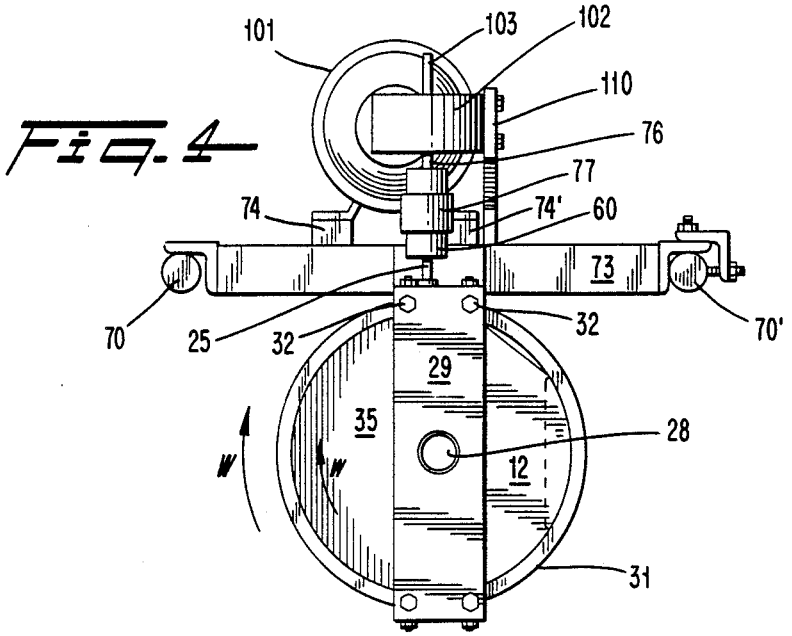
Fig. 4
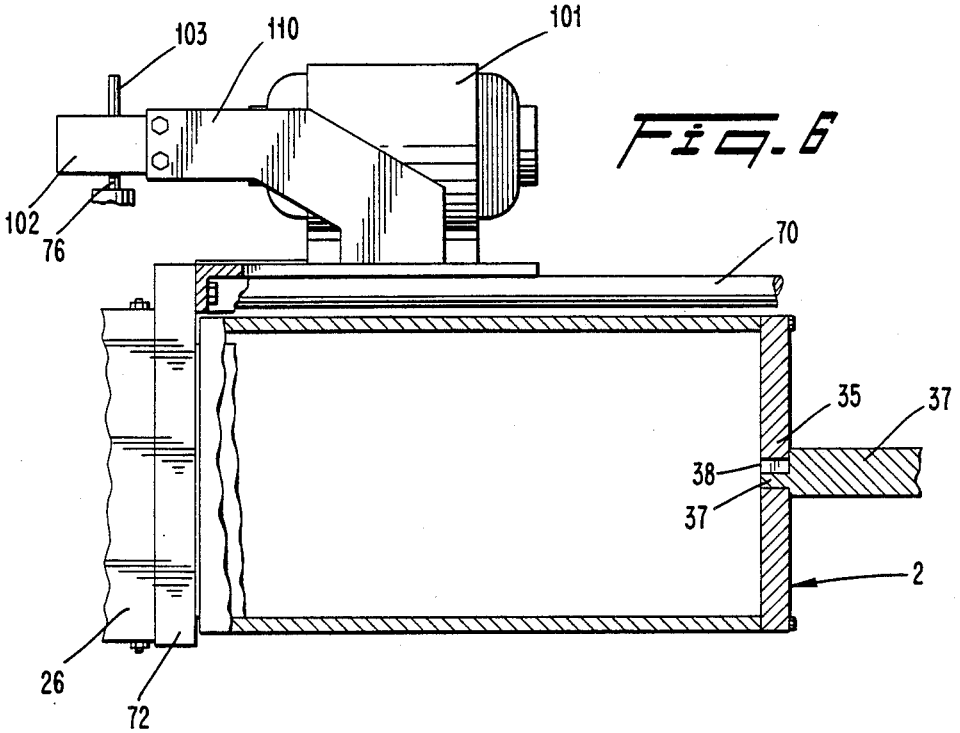
Fig. 6
Fig. 7
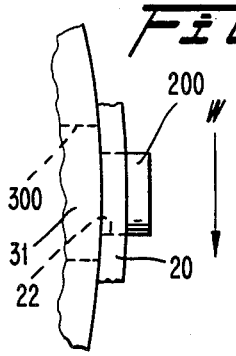
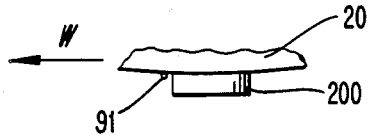
Fig. 8

GROUNDING DEVICE

BACKGROUND OF THE INVENTION

1. Field of the Invention

This invention relates to electrical connectors, and more particularly, to grounding lugs and connections for receptacles and clamps. In order to reduce the possibility of electrical shock, various electrical wiring systems, receptacles, switches and the like are required to be connected to ground. Most devices currently in use for making these ground connections are relatively difficult and time-consuming to use. The present invention, however, provides for quick and easy connection to ground.

2. Prior Art

There are numerous devices in the prior art for making ground connections in electrical wiring systems, including lay-in type grounding lugs as exemplified in U.S. Pat. Nos. 3,492,625, 4,159,859, 4,199,216, 4,248,490 and 4,355,852, and receptacle grounding clips as exemplified in U.S. Pat. Nos. 3,786,399, 3,885,847 and 4,392,012. The lay-in grounding lugs facilitate connection to electrical raceways and enable a ground wire to be connected between its ends with a device without requiring the ground wire to be threaded through or fed end-wise through the ground connection. The receptacle grounding clips establish a ground connection between an electrically conductive strap of an electrical receptacle to an electrically conductive mounting box.

Grounding lugs currently in widespread use on electrical receptacles comprise an electrically conductive body having a flange or foot thereon for attachment to the back plate of the receptacle by a screw extended therethrough, and an opening therethrough through which the ground wire is extended or threaded for attachment to the ground socket. This maneuver is difficult and time-consuming to accomplish and increases the cost of performing wiring services in residential and commercial installations.

All of the lay-in grounding lugs disclosed in the aforementioned patents relate to devices for coupling and grounding an electrical raceway and an electrical box to which it is assembled. These patents describe various structures, all essentially having a U-shaped portion into which a ground wire is laid and a screw for threading against the wire. None of these patents discloses or suggests a lay-in grounding lug which is constructed or suitable for use with an electrical receptacle for establishing a ground connection between the back plate and ground socket of the receptacle.

The patents disclosing grounding clips for electrical receptacles all teach separate clip devices which are connected between a grounding strap on the receptacle and the mounting box. None of them suggest the use of an existing assembly screw for holding in place the ground socket as a means for also establishing a ground connection between the receptacle back plate and ground socket. Moreover, none of these patents suggest an extension of the ground socket itself as a means of establishing a ground connection with the receptacle back plate.

SUMMARY OF THE INVENTION

The present invention provides a grounding device for electrical connectors, including, in a first variation, lay-in grounding lugs for use on existing wall receptacles and on clamps. In a second variation, automatic grounding connections are provided between the wall receptacle and mounting box.

The lay-in grounding lugs comprise a channeled base member and a clamping plate for releasable attachment to the base member to clamp a ground wire therebetween. The base member and clamping plate have interfitting flanges which react against a clamping screw threaded through the clamping plate into engagement with a wire laid in the channel of the base member. In use, a ground wire can be easily laid into the channeled base member and the clamping plate and screw then fitted, substantially increasing the ease and speed of making ground connections.

The automatic ground connections comprise a first form in which the screw that secures the ground socket to a receptacle also extends through the back plate of the receptacle, establishing a ground connection between the ground socket and the back plate. In a second form, an extension is provided from the ground wire clamping plate of the ground socket to the back plate of the receptacle, establishing a ground connection therewith.

BRIEF DESCRIPTION OF THE DRAWINGS

Other objects and advantages of this invention will be apparent from the following description and appended claims, reference being made to the accompanying drawings forming a part of the specification, wherein like reference characters designate corresponding parts in the several views, and wherein:

FIG. 4 is a top perspective exploded view of a second form of lay-in grounding lug for clamping to a pipe or the like;

DESCRIPTION OF THE PREFERRED EMBODIMENTS

Figure 1:
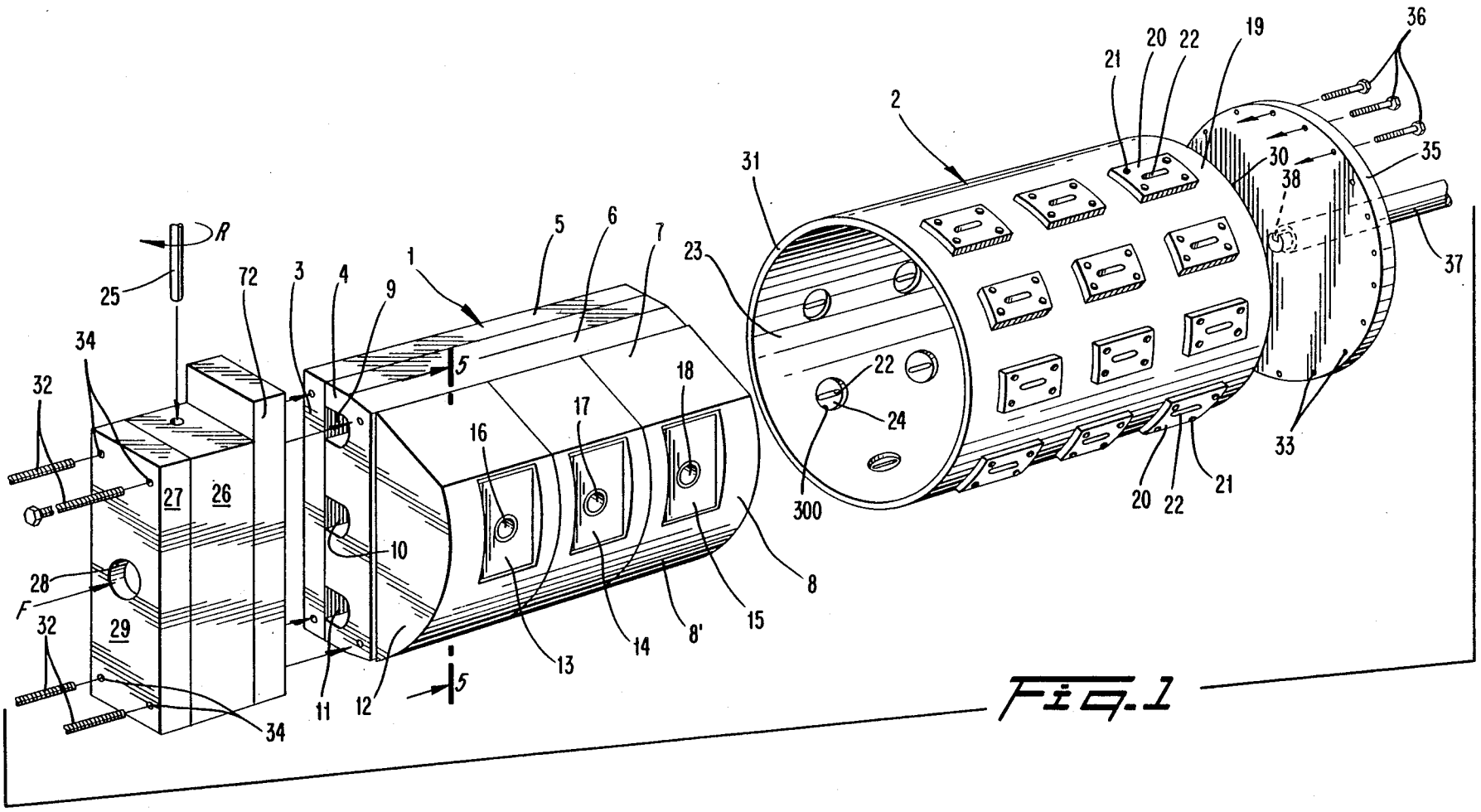
FIG. 1 is a top plan view, with the housing removed, of a wall-mounted electrical receptacle having a first form of lay-in grounding lug associated therewith.
Figure 2:
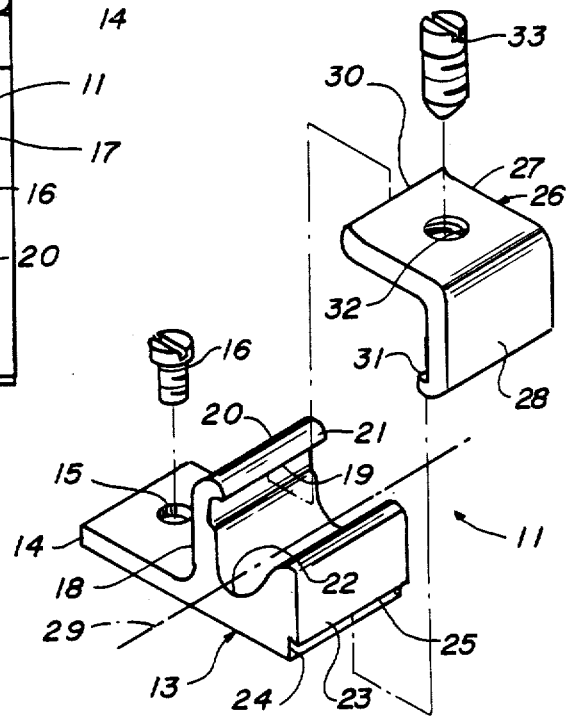
FIG. 2 is an exploded perspective view, greatly enlarged, of the lay-in grounding lug of FIG. 1.
Figure 3:
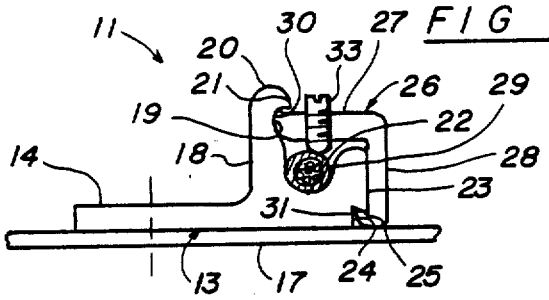
FIG. 3 is a side view in elevation of the lay-in grounding lug of FIGS. 1 and 2, showing the parts assembled with a ground wire clamped thereby.

A first form of the invention is shown at 10 in FIGS. 1–3, wherein a lay-in grounding lug 11 is adapted for use with a wall mount type electrical receptacle 12. The lay-in lug 11 comprises a channeled body 13 having a mounting flange 14 with an opening 15 therethrough for receiving an assembly screw 16 to secure the lug to the back plate 17 of the receptacle 12. An upstanding wall or flange 18 is formed on the upper surface of the body 13 approximately midway the length thereof, with an undercut portion 19 on one side near the upper end 20, and the upper end is shaped to define a hook-like flange or lip 21 facing toward the end of the body 13 opposite the mounting flange 14. This end of the body is also of substantially greater thickness than the mounting flange end and has a transversely extending wire-receiving channel 22 formed in the upper surface thereof. The lower outer end edge 23 of the thickened body portion is undercut at 24, defining a flange or lip 25. A clamping plate 26 having generally a "V" or "L" shape, with two legs 27 and 28, is adapted to cooperate with the body 13 to clamp a ground wire 29 therebetween. The clamping plate 26 has a lip or flange 30 formed on the end of one leg 27 and an upturned lip or flange 31 formed on the end of the other leg 28, for locking cooperation with the flanges 21 and 25, respectively. The leg 27 also has a threaded opening 32 formed therethrough for receiving a screw 33 which is threaded downwardly against the wire 29, securely gripping the wire and at the same time forcing the flanges of the clamping plate upwardly into secure locking engagement with the flanges of the body 13.

The lay-in grounding lug 11 may be made of any suitable material, such as brass, copper, steel, aluminum, etc., depending upon the intended use, and may be made in various sizes, again depending upon the intended use and the size of the wire to be engaged thereby. In the example shown, the grounding or bonding lug 11 is used with a 50 amp wall mounted electrical receptacle. In use, the channeled body 13 is simply secured to the back plate 17 of the receptacle with the screw 16 and the ground wire 29 then simply laid into the channel 22. Thereafter, the clamping plate is positioned over the body and wire, with the flanges on the clamping plate and on the body interengaged, and the screw 33 is turned down against the wire to securely lock the parts in position as shown in FIG. 3. This procedure is substantially less difficult to perform and significantly reduces the time it takes to wire a receptacle in comparison with prior art methods and structures. In prior art devices, the grounding or bonding lugs used merely have a hole or opening through the thickened body portion, and it is necessary to thread or feed the ground wire end-wise therethrough. This is not only difficult and time-consuming, but also imparts undue stress on the wire.

Figure 4:
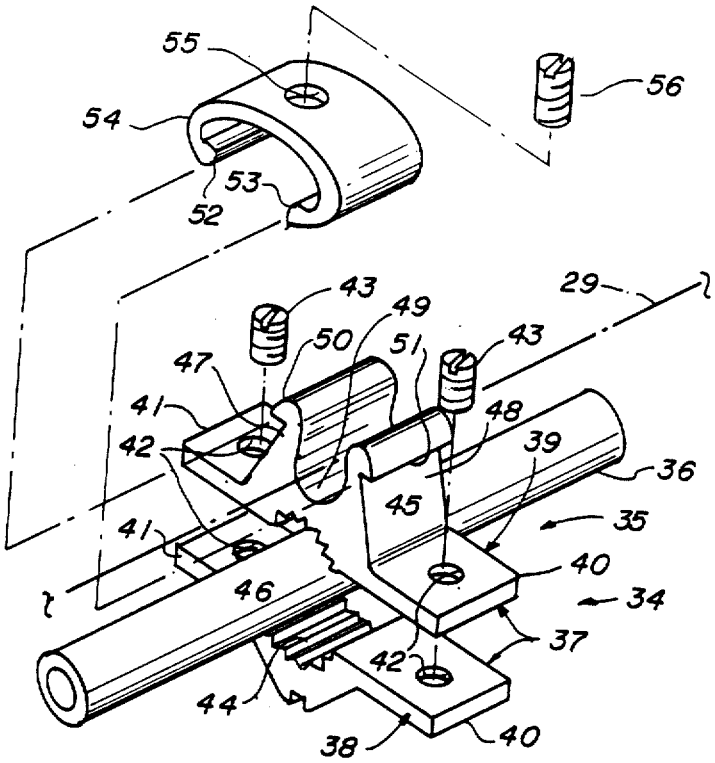
Figure 5:
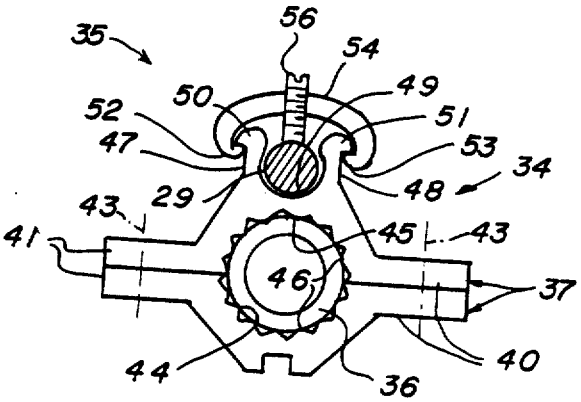
FIG. 5 is an assembled end view of the lay-in grounding lug of FIG. 4.
Figure 6:
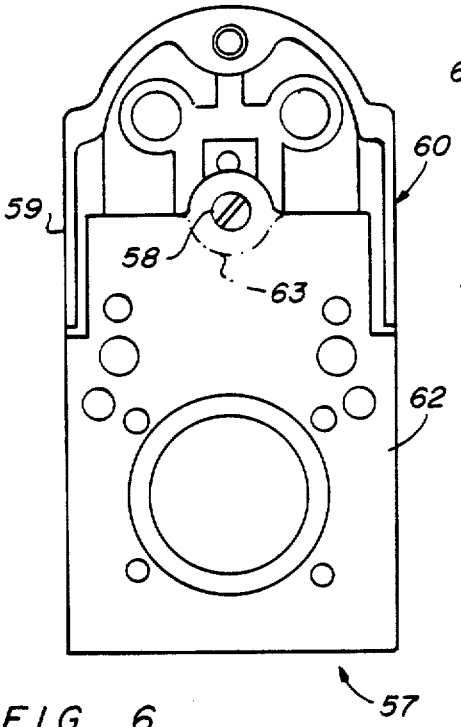
FIG. 6 is rear view of a wall-mounted receptacle such as shown in FIG. 1, with the grounding connection between the back plate and ground socket of the receptacle being made through the screw used to secure the ground socket to the receptacle.
Figure 7:
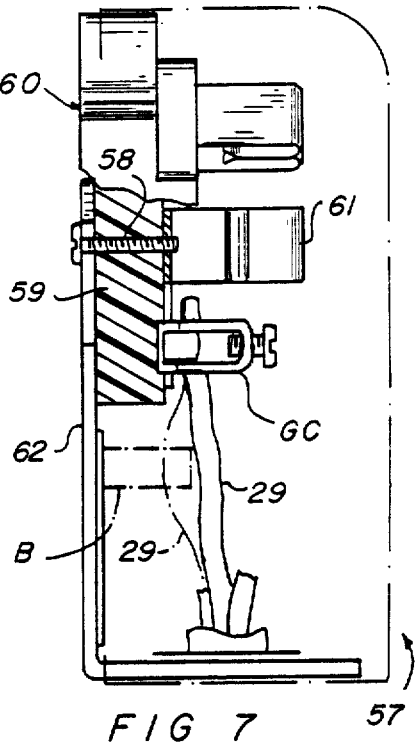
FIG. 7 is a side view, with parts shown in section, of the receptacle of FIG. 6.
Figure 8:
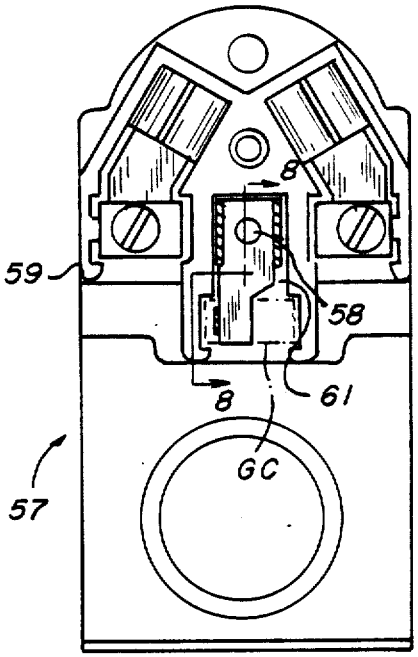
FIG. 8 is a front plan view of the receptacle of FIGS. 6 and 7.
Figure 9:
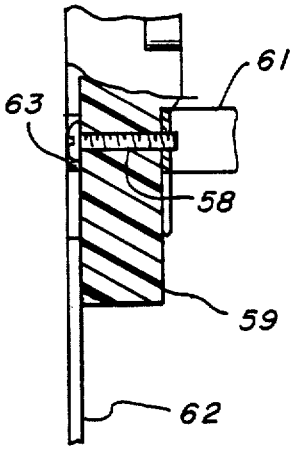
FIG 9 (PRIOR ART)
Figure 10:
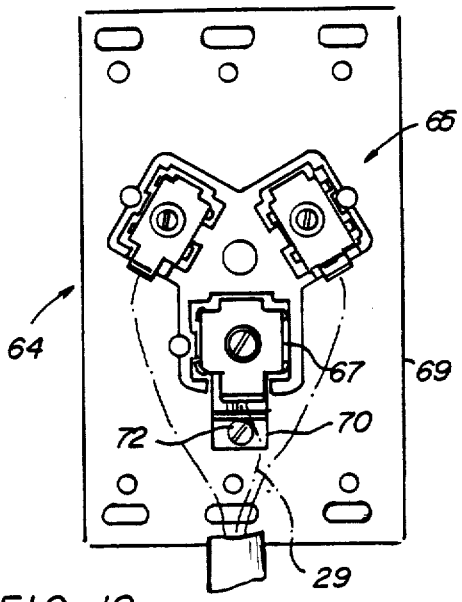
Figure 11:
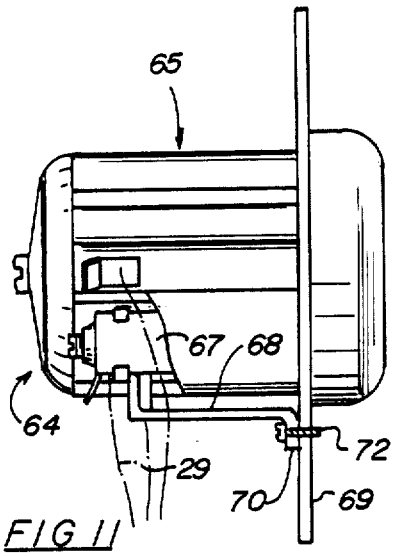
Figure 12:
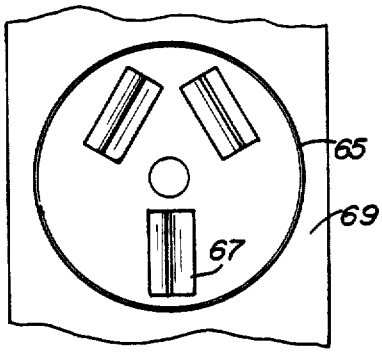
FIG. 12 is an enlarged, fragmentary view of the front of the receptacle of FIGS. 10 and 11.
Figure 13:
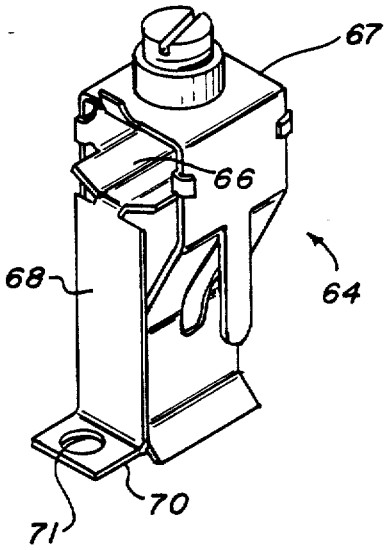
FIG. 13 is an enlarged perspective view of the ground socket with integral grounding connector thereon as used in the form of invention shown in FIGS. 10 through 12.
Figure 14:
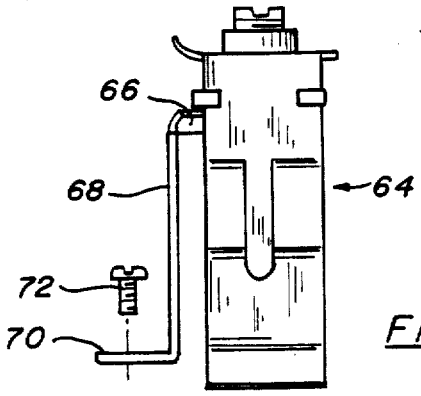
FIG. 14 is a side view in elevation of the ground socket and grounding connector of FIG. 13.

A second form of the invention is shown generally at 34 in FIGS. 4 and 5, and comprises a lay-in grounding lug 35 adapted to be positioned about a pipe or conduit 36 at any desired position along the length of the conduit. The grounding lug 35 has a split body 37, consisting of a bottom body portion 38 and a top body portion 39. The body portions each have outwardly extending, mutually parallel attaching flanges 40 and 41, with aligned openings 42 therethrough for receiving assembly screws 43 to clamp the body portions onto the conduit 36. The confronting surfaces of the body portions 38 and 39 are recessed or undercut at 44 and 45 in semicircular configurations to mate or match the circular configuration of the conduit 36. These undercut portions 44 and 45 are also serrated at 46 in order to firmly grip the conduit and prevent inadvertent displacement of the body 37 relative to the conduit. The top body portion 39 has a pair of spaced apart, upstanding walls or flanges 47 and 48, defining a wire-receiving channel 49 therebetween. The upper ends of the walls are shaped to form outwardly turned lips or flanges 50 and 51 for cooperation with complementally shaped inwardly turned lips or flanges 52 and 53 on the opposite sides of a clamping plate 54 adapted to be mounted on the body 37. The center of the clamping plate 54 has an opening 55 therethrough for threaded cooperation with a screw 56, which is extended downwardly through the clamping plate and into engagement with a ground wire 29 laid in the channel 49, forcing the plate upwardly to securely lock the parts in assembled relation as shown in FIG. 5.

Figure 9:
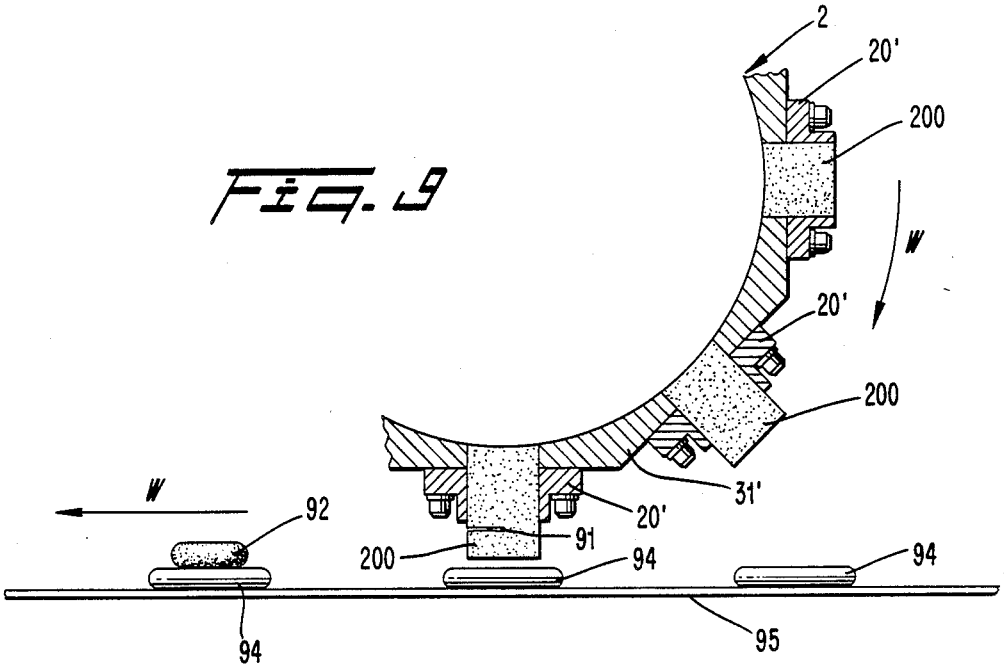
FIG. 9 is a fragmentary sectional view, similar to FIG. 7, of a prior art arrangement of the assembly screw, back plate and ground socket.
Figure 10:
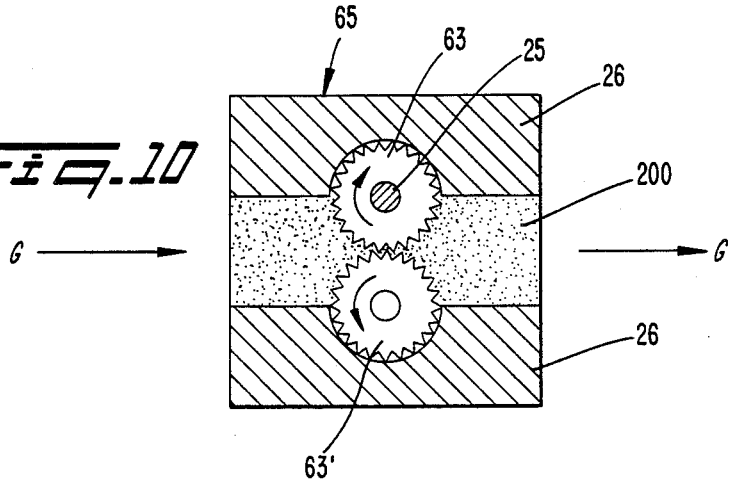
FIG. 10 is a rear view, with the cover or cap removed, of a flush mounting wall receptacle, showing a second form of grounding connection between the ground lug and back plate of the receptacle.
Figure 11:
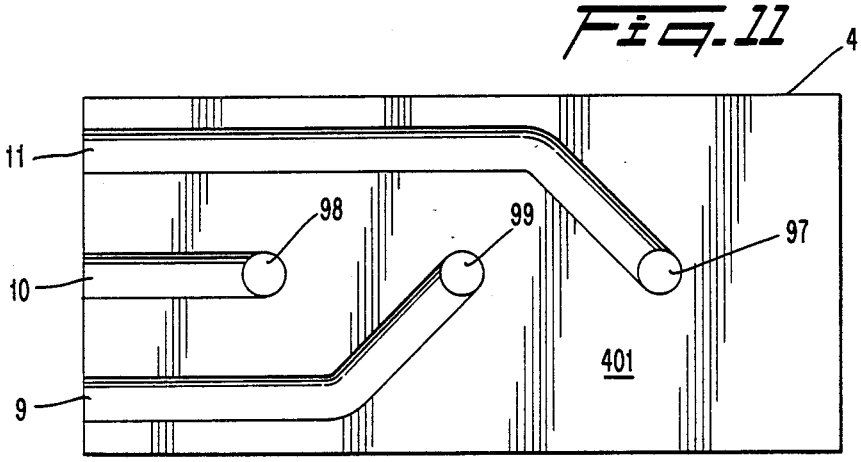
FIG. 11 is a side view in elevation, with a portion broken away, of the receptacle and grounding connection of FIG. 10.
Figure 1:
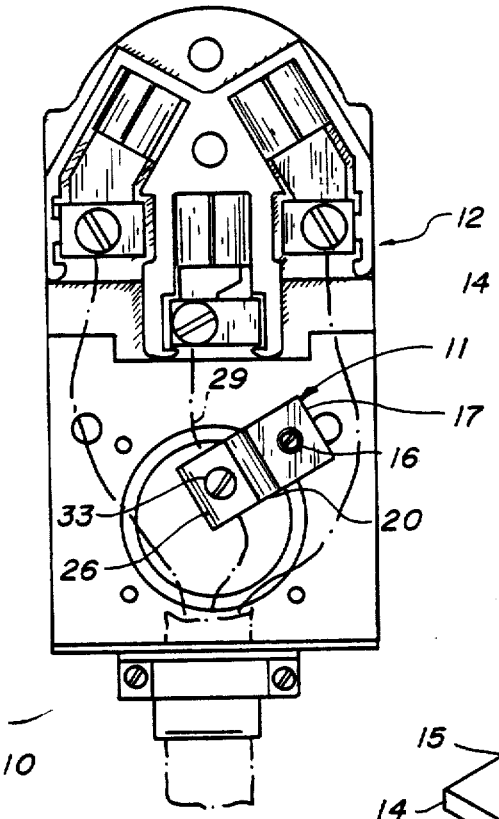

A third form of the invention is shown generally at 57 in FIGS. 6–9. In this form of the invention, the assembly screw 58 which extends through the body 59 of the receptacle 60 from the rear thereof to secure the ground socket 61 in place also is extended through the back plate 62 of the receptacle to establish a ground connection between the ground wire 29, ground socket 61 and back plate 62. In the prior art, as shown in dot-and-dash lines in FIGS. 6 and 7, the ground wire 29 is first fed through a bonding lug B attached to the back plate and then into the ground wire clamp GC. In prior art devices, the assembly screw 58 does not extend through the back plate, but instead the back plate is provided with a cut-out 63 as shown in dot-and-dash lines in FIG. 6, and as shown in FIG. 9. The ground connection from the ground wire and ground socket to the back plate is made via the bonding lug B. In this form of the invention, on the other hand, the ground connection between the ground wire and ground socket to the back plate is automatically accomplished by the assembly screw 58 which passes through the back plate 62. This eliminates the need for the bonding lug B and the concomitant time consuming and difficult task of feeding the ground wire through the bonding lug.

A fourth form of the invention is shown generally at 64 in FIGS. 10–14. In this form of the invention, shown in connection with a flush mount wall receptacle 65, the ground wire clamping plate 66 of the ground socket 67 is provided with an extension 68 projecting into proximity with the back plate 69 of the receptacle, and a laterally turned foot or flange 70 with an opening 71 therethrough for receiving a screw 72 to secure the foot to the back plate and establish a ground connection between the back plate 69, ground socket 67 and ground wire 29. The ground connection with the back plate is thus automatically accomplished and eliminates the need for a bonding lug (not shown) as required in the prior art, noted for example, in association with FIGS. 6–9.

The last two forms of the invention described herein are regarded as original equipment items, manufactured and assembled by the factory and eliminating the need for a bonding lug to establish ground with the back plate, while the first form described is regarded as an aftermarket or retrofit item, intended to be used in place of conventional bonding lugs.

I claim:

1. In a flush-mount wall receptacle including a body of electrically non-conductive material adapted to extend behind the surface of a wall, an electrically conductive ground plate adapted to lie substantially in the plane of the wall surface, and a plurality of electrically conductive sockets mounted in said body for connection with an electrical connector, one of said sockets comprising a ground socket for connection with a ground wire, said ground socket having an end wall spaced from the ground plate and a ground wire clamping plate spaced from the end wall to define an opening for receiving a ground wire, and a clamping screw extended through said end wall for engaging a ground wire positioned in said opening to clamp the wire against the clamping plate, the improvement comprising:

an extension integral with the clamping plate and extending at one end into contact with said ground plate for grounding the ground socket to the ground plate.

2. In a wall receptacle as claimed in claim 1, wherein:

said one end of the extension on the ground socket clamping plate has a laterally extending foot lying in parallel engagement with the ground plate; and a fastener is extended through the foot and into the ground plate to fasten the extension to the ground plate in electrically conductive relationship therewith.

3. In a wall receptacle comprising an electrically conductive back plate with an end wall extending at substantially a right angle thereto and having an opening through which an electrical cable is adapted to be extended, a socket body of electrically non-conductive material carried on the back plate in spaced relationship to the end wall, and a plurality of electrical sockets mounted in the socket body for connection with an electrical connector, one of said sockets comprising a ground socket for connection with a ground wire carried by said cable, the improvement comprising:

a lay-in grounding lug secured to said back plate between the end wall and socket body for receiving said ground wire and grounding it to the back plate, the grounding lug comprising a body having a relatively thick end with a channel formed across the width thereof between a pair of spaced apart, upstanding flanges having downwardly oriented shoulders, a mounting flange on the other end of the grounding lug body, projecting from one end of the body such that the body and mounting flange define a coplanar back surface lying in contact with the back plate of the receptacle, said mounting flange having an opening therethrough in aligned registry with a pre-existing opening formed through the back plate, and a fastener extended through the aligned openings, securing the grounding lug to the back plate with the axis of the channel aligned in the path of the ground wire extending from the opening in the end wall to the socket body, and a clamping plate having flanges on opposite side edges thereof for engagement beneath the shoulders on the grounding lug, said clamping plate having an opening therethrough for receiving a fastener therethrough to clamp the grounding wire in the channel of the grounding lug.

4. In a wall receptacle as claimed in claim 3, wherein:

said shoulders are formed on the same side of their respective flanges, thereby facing in the same direction; and said clamping plate is generally L-shaped, having a flange on the free end of each leg of the "L" for cooperative engagement with the flanges on the body.

5. In a wall receptacle comprising an electrically conductive back plate with an end wall extending at substantially a right angle thereto and having an opening through which an electrical cable is adapted to be extended, a socket body of electrically non-conductive material carried on the back plate in spaced relationship to the end wall, and a plurality of electrical sockets mounted in the socket body for connection with an electrical connector, one of said sockets comprising a ground socket for connection with a ground wire carried by said cable, the improvement comprising:

an assembly screw extended through the back plate and socket body into engagement with the ground socket to secure the ground socket to the body, the assembly screw establishing a ground connection between the ground socket and the back plate and also holding the ground socket to the body, thereby eliminating the need for a separate grounding lug to establish a ground connection between the ground socket and the back plate.

* * * * *

UNITED STATES PATENT AND TRADEMARK OFFICE

CERTIFICATE OF CORRECTION

PATENT NO. : 4,632,477

DATED : December 30, 1986

INVENTOR(S) : Monroe E. Alger

It is certified that error appears in the above-identified patent and that said Letters Patent is hereby corrected as shown below:

The title page showing the illustrative figure should be deleted to appear as per attached title page.

In the drawing the four (4) sheets of drawing should be deleted to be replaced with the drawing consisting of FIGS. 1 - 14, as shown on the attached sheets.

Signed and Sealed this

Twentieth Day of December, 1988

*Attest:*

DONALD J. QUIGG

*Attesting Officer*

*Commissioner of Patents and Trademarks*

United States Patent [19]

Alger

[11] Patent Number: 4,632,477

[45] Date of Patent: Dec. 30, 1986

[54] GROUNDING DEVICE

[76] Inventor: Monroe E. Alger, 10309 Godwin Dr., Manassas, Va. 22110

[21] Appl. No.: 710,122

[22] Filed: Mar. 11, 1985

[51] Int. Cl.[4] ..... H01R 4/66

[52] U.S. Cl. ..... 339/14 R; 339/14 L; 339/272 R

[58] Field of Search ..... 339/14, 272 R, 13, 266 G, 339/192 R; 174/51; 220/3.2, 3.3

[56] References Cited

U.S. PATENT DOCUMENTS

| | | | |
|---|---|---|---|
| 1,791,264 | 2/1931 | Chaney et al. | 174/51 X |
| 2,337,212 | 12/1943 | Thomson et al. | 339/192 R X |
| 2,533,897 | 12/1950 | Reddock | 339/13 X |
| 3,325,776 | 6/1967 | Eppler | 339/272 R |
| 3,390,368 | 6/1968 | Archer | 339/14 R |
| 4,159,859 | 7/1979 | Shemtov | 339/14 L |
| 4,189,198 | 2/1980 | Reichman | 339/14 L X |
| 4,427,258 | 1/1984 | Mueller | 339/272 R |

*Primary Examiner*—Eugene F. Desmond
*Attorney, Agent, or Firm*—Dennis H. Lambert

[57] ABSTRACT

A grounding device for electrical connectors includes, in a first variation, lay-in grounding lugs for use on existing wall receptacles and on clamps, and, in a second variation, automatic grounding connections between the ground socket and back plate of an electrical receptacle. The lay-in grounding lugs comprise a channeled body and a clamping plate for releasable attachment to the body to clamp a ground wire therebetween. The body and clamping plate have interfitting flanges which react against a clamping screw threaded through the clamping plate into engagement with a wire laid in the channel of the body. In use, a ground wire can be easily laid into the channel and the clamping plate and screw then fitted, substantially increasing the ease and speed of making ground connections. The automatic ground connections comprise a first form in which the screw that secures the ground socket to the receptacle also extends through the back plate of the receptacle, establishing a ground connection between the ground socket and the back plate. In a second form, an extension is provided from the ground wire clamping plate of the ground socket to the back plate of the receptacle, establishing a ground connection therebetween.

5 Claims, 14 Drawing Figures

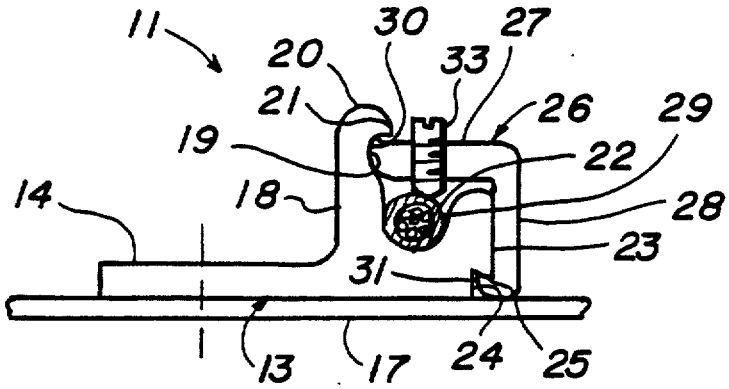

Patent No. 4,632,477 December 30, 1986

Monroe E. Alger

Monroe E. Alger

Monroe E. Alger